United States Patent [19]

Howard, deceased et al.

[11] Patent Number: 5,062,803

[45] Date of Patent: Nov. 5, 1991

[54] PLUG PULLER

[76] Inventors: Perry C. Howard, deceased, late of Naples; by Moses W. Howard, 1959 Fourth Street Ct., Naples, both of Fla. 33940

[21] Appl. No.: 596,962

[22] Filed: Oct. 15, 1990

[51] Int. Cl.[5] ..... H01R 13/62

[52] U.S. Cl. ..... 439/160; 439/484

[58] Field of Search ..... 439/152, 159, 160, 476, 439/477, 478, 479, 480, 481, 482, 483, 484

[56] References Cited

U.S. PATENT DOCUMENTS

| | | | |
|---|---|---|---|
| 1,618,723 | 2/1927 | Pearson . | |
| 1,677,622 | 7/1928 | Dreuil | 439/483 |
| 1,765,035 | 6/1930 | Stubbs | 439/483 |
| 1,900,782 | 3/1933 | Way . | |
| 2,051,425 | 8/1936 | Schlums . | |
| 2,986,719 | 5/1961 | Adams . | |
| 3,008,115 | 11/1961 | Oakes . | |
| 3,160,947 | 12/1964 | Sunderlin | 439/152 |
| 3,431,535 | 3/1969 | Munyon | 439/484 |
| 4,210,377 | 7/1980 | La Vogue | 439/484 |
| 4,586,768 | 5/1986 | Eck | 439/160 |
| 4,957,450 | 9/1990 | Pioszak | 439/369 |

FOREIGN PATENT DOCUMENTS

| | | | |
|---|---|---|---|
| 507440 | 6/1939 | United Kingdom | 439/371 |

*Primary Examiner*—David L. Pirlot

*Attorney, Agent, or Firm*—Hill, Van Santen, Steadman & Simpson

[57] ABSTRACT

A device for disengaging a plug member from a receptacle includes an elongated strap member having an aperture therein for each prong or element of the plug which inserts into the receptacle, each aperture operatively engaging about its corresponding prong or element of the plug; the strap member forming a loop about the plug when mounted thereon and having flat faces with no protruding elements for latch ends of the strap together.

20 Claims, 1 Drawing Sheet

82
80
72
70
68
64
66
65

64
33
32
60
30

62
35

104
100
106
102
42

49
48
47
41
49
40
43
44
32
36
31

33
30
35
34
37
53
57
59
58
50

10
12
15
11
14
16
13
48
17
19

10
19
92
90
94

PLUG PULLER

BACKGROUND OF THE INVENTION

The present invention relates generally to plugs and, specifically, to a plug puller.

Plugs of a variety of sorts are used for frictional couplings together of two items. Plugs can be used to cooperate with sockets or receptacles to couple electrical, pneumatic, etc., cables, conduits, etc., to the sockets or receptacles.

Electrical plugs are devices that allow for easy frictional electrical coupling of an electrical cord to a power source outlet or socket. An electrical plug comprises a housing member supporting prongs extending from one end thereof that are frictionally accepted into the outlet or socket. An electrical cord is accepted through an aperture in the housing member and metal wires in the cord are appropriately connected to the prongs.

The housing members of electrical plugs are formed in a variety of shapes, usually cubicle or hemispherical. Typically, a housing member is of a relatively small size.

Due to the shape and size of a housing member of an electrical shape, invariably it is difficult to disconnect and remove it from an outlet, especially if it is located in a hard to access outlet or socket behind, for example, a heavy couch or counter. A hemispherically-shaped housing member is particularly difficult to grasp because of its rounded shape.

Invariably, it is easier for a person to simply grasp and pull the electrical cord attached to the plug to pull the plug out of the outlet or socket. However, this is a dangerous practice as the connections between the wires and the prongs can weaken, raising the probability that a disconnected or broken strand of one wire may touch the other wire and cause a short circuit within the plug. Additionally, the cord can become completely detached from the plug.

Several devices for disconnecting and removing electrical plugs from sockets are disclosed in the patent literature.

The United States patent to Pearson, U.S. Pat. No. 1,618,723, discloses a plug attachment having at least two apertures formed on a first surface that accept the prongs of an electrical cord plug. Two outwardly curved arms extend away from the first portion for a user to grasp and form an interior pocket that accepts the electrical plug.

The United States patents to Way, U.S. Pat. No. 1,900,782; Schlums, U.S. Pat. No. 2,051,425; and Oakes, U.S. Pat. No. 3,008,115, disclose electrical plugs that have outwardly extending engagement members. These engagement members are activated by a user and, in turn, pivot or flex to engage the face plate of an electrical outlet or socket to force the plug away from the outlet or socket.

The United States patent to Adams, U.S. Pat. No. 2,986,719, discloses a safety release electrical plug having outwardly extending fins or a circular housing. The fins or housing engage the electrical cord at a sufficient distance from the plug to be disconnected and removed from the outlet or socket by merely tugging on the cord.

The United States patent to Sunderlin, U.S. Pat. No. 3,160,947, discloses an electrical plug puller constructed from an elongated piece of material having a central portion with at least two slotted apertures for receiving the prongs of an electrical plug. At either end of the elongated member are two rings that are grasped by the user to remove the plug from a socket. A stud formed near one of the rings is received within an aperture near the other ring to secure the two ring members together so as to prevent them from hanging in an extended position at which they can be more easily grasped.

There also exists a variety of other plugs involving similar problems with disconnecting of same. For example, pneumatic lines can employ cooperating frictional coupling members. Invariably, it is easier to grasp and tug a pneumatic line to discouple the line rather than to grasp and tub the appropriate coupling members to separate same. As a result, if the coupling frictional forces are great enough, the line can become detached from the coupling member retained coupled to the cooperating coupling member.

SUMMARY OF THE INVENTION

In accordance with principles of the invention, a device for disconnecting and removing a plug from a socket or a coupling member from a cooperating coupling member includes an elongated strap member having therein an aperture or set of apertures for engaging the plug or coupling member and a handle portion which can be grasped to pull the plug or coupling member away from the socket or cooperating coupling member, respectively, in disengaging fashion. In a preferred embodiment, the handle portion includes an aperture for supporting the handle portion on a cable or conduit attached to the plug or coupling member.

In one embodiment, the elongated aperture through which the plug and cord can be threaded is located in the central portion and each of the end portions has a set of apertures accepting the prongs of the plug.

In another embodiment, each of the end portions has an elongated aperture through which the plug and cord can be threaded and the central portion has a set of apertures accepting the prongs of the plug.

In yet another embodiment, each aperture through which can be threaded the plug and cord includes cooperating notches located on opposite sides of the elongated aperture for supporting the strap member on the cord.

In yet a further embodiment, the apertures accepting the prongs of the plug are formed of relatively short elongated apertures and these apertures as well as the elongated aperture through which can be threaded the plug and cord attached thereto include circular cutouts located at opposite ends of the apertures in communication with the apertures to prevent tearing of the strap member at the ends of the apertures.

DETAILED DESCRIPTION OF THE PRESENTLY PREFERRED EMBODIMENTS

Figures 1, 2, 3, 4, 5, 6, 7, 8, 9, 10:
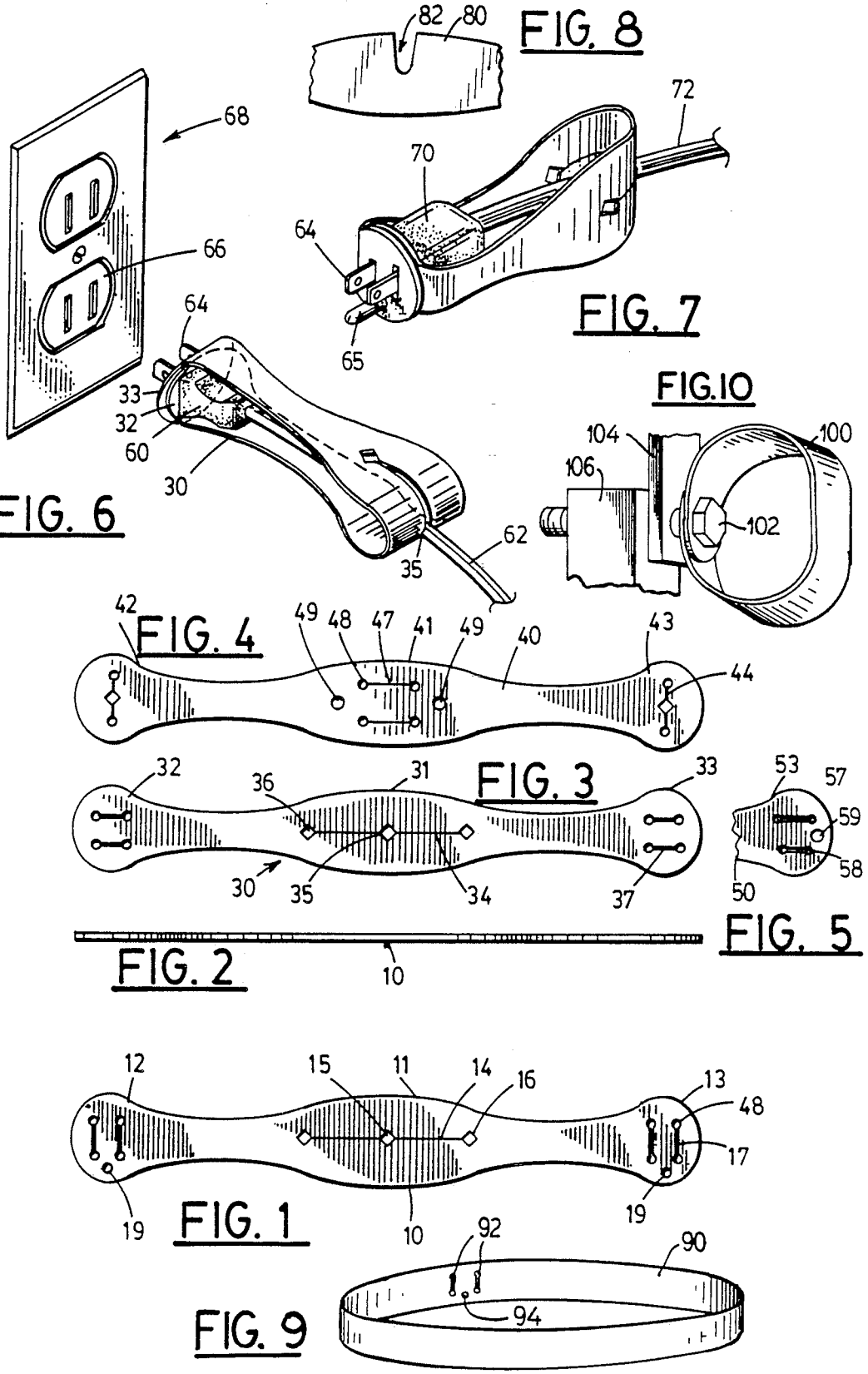
FIG. 1 is a top view of an electric plug puller formed in accordance with principles of the invention.
FIG. 2 is a side view of the electric plug puller of FIG. 1.
FIG. 3 is a top view of another electric plug puller formed in accordance with principles of the invention.
FIG. 4 is a top view of yet another electric plug puller formed in accordance with principles of the invention.
FIG. 5 is a partial top view of an end portion of a strap member of an electric plug puller formed in accordance with principles of the invention.
FIG. 6 is a perspective view of the electric plug puller of FIG. 3 shown mounted on a plug and cord attached thereto.
FIG. 7 is a perspective view illustrating the electric plug puller of FIG. 1 mounted on a plug and cord attached thereto.
FIG. 8 is a fragmentary view of another plug puller formed in accordance with principles of the invention illustrating an alternative structure for capturing a chord attached to a plug.
FIG. 9 is a perspective view of yet another plug puller embodying principles of the invention.
FIG. 10 is a perspective view of a non-electrical plug puller embodying principles of the invention.

The present invention in its presently preferred embodiments provides devices for disconnecting and removing an electrical plug from a socket, hereinafter referred to as electrical plug pullers. The devices include elongated strap members that are supported about a cord attached to the plug that engage the prongs of the plug.

In FIG. 1 there is illustrated one preferred embodiment of the present invention. An elongated strap member 10 includes a central portion 11 and two end portions 12 and 13. The strap member is made of an electrically non-conductive material at least at the portions, described later, which engage prongs of an electrical plug. Suitable materials include a pliable rubber or bendable plastic.

As illustrated, the central portion 11 of the strap member 10 includes an elongated aperture 14, preferably formed by a slit running lengthwise along the central portion 11. Other forms of apertures may be used which fall within the spirit and scope of the invention, such as slots (slots as used herein meaning an aperture slightly wider than a simple slice in the strap member 10), so long as they perform the functions described below.

At a central location along the aperture 14, a pair of cooperating notches 15 are formed on opposite sides of the aperture. The notches 15 cooperate with an electrical cord attached to an electrical plug threaded through the aperture 14 as shown in FIGS. 6 and 7 to support the strap member 10 about and on the electrical cord. The notches 15 are illustrated as being triangular in shape, however, other shapes such as rectangles can be used that will engage and cooperate with an electrical cord.

Opposite ends of the aperture 14 are formed cutouts 16. The cutouts 16 are in communication with the aperture 14 and serve to prevent tearing of the strap member 10 at the ends of the aperture 14 when an electrical plug and cord attached thereto are threaded through the aperture 14. As illustrated, the cutouts 16 are diamond-shaped. However, the cutouts 16 can be formed of other shapes such as circles and still fall within the spirit and scope of the invention.

The end portions 12 and 13 are similarly formed, one being the mirror image of the other. The end portions 12 and 13 include slotted apertures 17 that accept the flat prongs and apertures 19 that accept the grounding prong of an electrical cord as is clearly shown in FIGS. 6 and 7. The apertures 17 are illustrated as slots because apertures formed as slots accept the flat prongs of electrical plugs more easily than, for example, apertures formed of slits or slices in the strap member 10. The apertures 19 need not be included if a ground prong is not provided on the electrical cord.

Additionally, the apertures 17 include cutouts 18 formed at opposite ends thereof. These cutouts are in communication with the aperture 17 and prevent tearing of the strap member 10 upon insertion of the prongs of the electrical plug through the aperture 17. Again, the cutouts 18 may be of any suitable shape which serves the described function, the circular shape illustrated merely being the presently preferred embodiment.

The apertures 17 are illustrated as being perpendicularly oriented to the length of the strap member 10. However, the apertures 17 can also be formed so as to be oriented parallel to the length of the strap member 10 as is apparent in the other figures.

In FIG. 2 there is illustrated a side view of the strap member 10 to show the relatively thin profile of the strap member 10. The strap member 10 must be capable of bending as is illustrated in FIGS. 6 and 7 and therefore, must be made of a material which is flexible. Ideally, a plastic material which is bendable yet somewhat rigid is used. Thus, when the strap member 10 is supported about the electrical cord, it will not collapse about the cord attached to the plug as is illustrated in FIGS. 6 and 7.

In FIG. 3 there is illustrated an alternate embodiment of the invention. A strap member 30 similar to the strap member 10 also includes a central portion 31 and end portions 32 and 33. The central portion 31 includes an aperture 34 similar to the aperture 14 and will not be described further.

The end portions 32 and 33 include apertures 37 which are similar in shape to the apertures 17 of the strap member 10 but which are oriented parallel to the length of the strap member 37.

In FIG. 4 there is illustrated another alternative embodiment of the invention. A strap member 40 similar to the strap members 10 and 30 includes a central portion 41 and end portions 42 and 43. Unlike the other embodiments discussed above, the central portion 41 includes apertures 47 for accepting prongs of an electrical plug. The apertures 47 are formed similarly to the apertures 17 and 37 and will not be described further except to say that they are oriented parallel to the length of the strap member 40. Further, the central portion 41 includes additional apertures 49 for accepting the ground prong of a plug which includes three prongs. As most ground prongs are tubular in shape and therefore, have circular cross sections, the apertures 48 are illustrated as being circular in shape. Two apertures 49 are shown on opposite sides of the central portion 41 to allow accepting of the ground prong of the electrical plug on either side of the central portion 41. Because the prong accepting apertures are located in the central portion 41 of the strap member 40, necessarily, the end portions 42 and 43 include apertures 44 through which the electrical plug and cord attached thereto can be threaded. The apertures 44 are similar to the apertures 14 and 34 and need not be described further except to say that they can be oriented either along the length of the strap member 40 or perpendicular to the length of the strap member 40.

In FIG. 5 there is shown yet a further embodiment of the invention. Only the end portion 53 of a strap member 50 is illustrated as it is the only portion which differs from the embodiments described previously. As can be seen the end portion 53 includes apertures 57 for accepting prongs of an electrical plug which are formed with slots having cutouts 58 formed at opposite ends of the apertures 57. Moreover, the end portion 53 includes an aperture 59 formed of a circular hole for accepting the ground prong of an electrical plug.

In FIG. 6 there is illustrated in perspective view a strap member 30 mounted on a plug 60 with an electrical cord 62 attached hereto. As can be appreciated, the notch members 35 engage the cord 62 to support the strap member 30 on the cord 62. The end portions 32 and 33 accept the prongs 64 of the plugs 60 in overlying relationship, the end portion 32 being received first on the prong 64 and the end portion 33 being engaged thereover.

Once the strap member 30 is mounted on the plug and cord as illustrated, the plug 60 is ready for engagement with the socket 66 of wall outlet 68.

As can be appreciated, when it is desired to disconnect and remove the plug 60 from the socket 66, one simply grasps the strap member 30 along the central portion 31 and simply pulls at the strap member until the plug 60 is removed from the socket 66. Because one is grasping and pulling on the strap member 30 instead of the cord 62, no strain is placed at that point where the cord 62 is attached to the plug 60 and therefore, much wear and tear on the cord is avoided.

In FIG. 7 there is illustrated a strap member 50 mounted on a plug 70 with cord 72 attached thereto. Plug 70 includes three prongs, prongs 64 for transmission of electrical power and prong 65 for grounding purposes. The strap member 50 is mounted in a fashion similar to that discussed with respect to the strap member 30 as illustrated in FIG. 6 and thus, need not be described further.

In FIG. 8 there is illustrated a portion of a strap member that includes a notch 82 formed therein. It can be appreciated that in the strap member 80 are formed so as to engage a plug as discussed throughout this description. The notch 82 can be placed anywhere along the strap member 80 that is appropriate so that a cord member can be engaged therein. Accordingly, elongated apertures are not utilized in connection with the strap member 80 for engaging the cord member passed therethrough so as to secure the strap member to the cord member. Instead, the cord member is engaged through the notch 82.

In FIG. 9, there is illustrated an alternate embodiment to the invention wherein a strap member 90 is formed of a continuous loop of material. The strap member 90 includes a pair of apertures 92 and a single aperture 94 for engaging an electrical plug therein as described in connection with the previous embodiments. Accordingly, it can be appreciated if the strap member 90 is formed of a sufficiently rigid material, when the plug is plugged into a socket, the strap member 90 will extend from the socket in an easily graspable fashion. The cord of the plug can be permitted to extend downwardly through the interior of the strap member 90. Thus, when removable of the plug is desired, one need only grasp the strap member 90 and pull same away from the socket. There is no need to grasp and pull the cord.

In FIG. 10, there is illustrated yet another embodiment of the invention wherein a strap member 100 in accordance with principles of the invention is employed in connection with a pin member 102 that frictionally engages in appropriately formed openings into bar members 104 and 106 that are to be coupled together. In a manner similar to the previously discussed plugs, the pin 102 can be extracted from the openings of the bar members 104 and 106 by simply grasping the strap member 100.

It can be appreciated that the principles of the invention are applicable to any plug or pin member that is to be extracted from a cooperating receptacle. The invention is not restricted simply to electrical plugs. However, it is envisioned that the principle application of the invention will be in this area inasmuch as it is the danger of the separation of a plug from its associated cord that is of the greatest danger.

Furthermore, it can be appreciated that in connection with all of the above-described strap members, they are formed so as to have completely planar surfaces on both the flat sides thereof. These surfaces are especially adapted for the placement thereon of indicia such as advertising symbols, letters, etc. Accordingly, indicia can be appropriately placed on a strap member embodying principles of the invention so as to continuously expose such indicia on an outer surface thereof.

While a preferred embodiment has been shown, modifications and changes may become apparent to those skilled in the art which shall fall within the spirit and scope of the invention. It is intended that such modifications and changes be covered by the attached claims.

I claim:

1. A device for disengaging a plug member from a receptacle, comprising:

an elongated strap member, said strap member having flat faces for latching together ends of said strap member; and an aperture formed in the strap member for each portion of said plug member that is to be inserted into said receptacle, each aperture being formed so as to operatively engage about its corresponding portion of said plug member to be inserted into said receptacle, said strap member being mounted on said plug member so as to form a loop thereabout so that said loop can be grasped and pulled at a rear portion thereof at a distance from said plug member to disengage said plug member from said receptacle;

and wherein:

said elongated strap member is made of an electrically non-conductive material and has a central portion and two end portions located on opposite sides of said central portion, at least one of said central and end portions having an elongated aperture through which said plug member and an electrical cord attached thereto can be threaded, at least one of said central and end portions having a set of two or more apertures accepting prongs of said plug member.

2. The device of claim 1, wherein said central portion has said elongated aperture through which said plug member and cord can be threaded and each of said end portions has a set of apertures accepting said prongs.

3. A device for disengaging a plug member from a receptacle, comprising:

an elongated strap member, said strap member having flat faces for latching together ends of said strap member; and an aperture formed in the strap member for each portion of said plug member that is to be inserted into said receptacle, each aperture being formed so as to operatively engage about its corresponding portion of said plug member to be inserted into said receptacle, said strap member being mounted on said plug member so as to form a loop thereabout so that said loop can be grasped and pulled at a rear portion thereof not engaged by said plug member to disengage said plug member from said receptacle;

wherein:

said elongated strap member is made of an electrically non-conductive material and has a central portion and two end portions located on opposite sides of said central portion; and wherein each of said end portions has an elongated aperture through which said plug member and cord can be threaded and said central portion has said set of apertures accepting said prongs.

4. The device of claim 1, wherein each set of apertures accepting said prongs includes two relatively short elongated apertures accepting power transmission prongs of said plug member.

5. A device as claimed in claim 4, wherein each set of apertures accepting said prongs includes a circular aperture accepting a ground prong of said plug member.

6. A device as set forth in claim 1, wherein each elongated aperture through which said plug and cord can be threaded includes means for supporting said elongated strap member on said cord at said distance from said plug.

7. A device as set forth in claim 6, wherein said means for supporting said elongated strap member on said cord includes cooperating notches located on opposite sides of said elongated aperture.

8. A device as claimed in claim 1, wherein said aperture includes means for preventing tearing of said elongated strap member at ends of said apertures.

9. A device as claimed in claim 8, wherein said means for preventing tearing includes circular cutouts located at ends of said apertures in communication with said apertures.

10. A device for disconnecting or removing an electrical plug from a socket, comprising:

an elongated strap member made of an electrically non-conductive material having a central portion and end portions located on opposite ends of said member, an elongated central aperture located in said central portion through which said plug and a cord attached thereto can be threaded, said elongated aperture including cooperating notches on opposite sides thereof for supporting said strap member on said cord, said elongated member further including circular cutouts located at ends of said central aperture and in communication therewith to prevent tearing of said strap member at said ends of said central aperture; and a set of prong apertures located at each of said end portions accepting prongs of said plug, each set of prong apertures having relatively short elongated apertures with circular cutouts located at ends of said prong apertures to prevent tearing of said strap member at said ends of said prong apertures.

11. A device as set forth in claim 10, wherein each set of said prong apertures further includes an aperture accepting a ground prong of said plug.

12. A device for disconnecting and removing an electrical plug from a socket, comprising:

a flexible strap member having a central portion and two end portions located on opposite sides of said central portion, at least one of said central and end portions having a first aperture through which said plug and an electrical cord attached thereto can be threaded, said strap fashioned so said first aperture surrounds said cord spaced from said plug, at least another one of said central and end portions having a set of at least two apertures accepting prongs of said plug and being made of an electrically non-conductive material.

13. A device as claimed in claim 12, wherein said central portion has said elongated apertures through which said plug and cord can be threaded and each of said end portions has set of apertures accepting said prongs.

14. A device for disconnecting and removing an electrical plug from a socket, comprising:

a flexible strap member having a central portion and two end portions located on opposite sides of said central portion, being made of an electrically non-conductive material; and wherein each of said end portions has an elongated aperture through which said plug and cord can be threaded and said central portion has a set of at least two apertures accepting said prongs.

15. A device as claimed in claim 12, wherein said first aperture includes means for preventing tearing of said strap member at ends of said aperture.

16. A device as claimed in claim 15, wherein said means for preventing tearing includes circular cutouts located at ends of said first aperture in communication with said apertures.

17. A device as claimed in claim 15, wherein said means for preventing tearing includes triangular cutouts located at ends of said first aperture in communication with said apertures.

18. A device as claimed in claim 12, wherein each set of apertures accepting said prongs includes two relatively short elongated apertures accepting power transmission prongs of said plug.

19. A device as claimed in claim 18, wherein said apertures accepting said prongs are oriented parallel to the length of said strap member.

20. A device as claimed in claim 18, wherein said apertures accepting said prongs are oriented perpendicularly to the length of said strap member.

* * * * *